United States Patent [19]

Chazin

[11] Patent Number: 4,627,414

[45] Date of Patent: Dec. 9, 1986

[54] STAND FOR SUPPORTING COOKING LIQUID SPRAY DISPENSER RELATIVE TO A HEATED SURFACE AND CONTROLLING THE TEMPERATURE OF THE LIQUID

[76] Inventor: Neal H. Chazin, 1305 Rexford Ave., Pasadena, Calif. 91107

[21] Appl. No.: 679,546

[22] Filed: Dec. 7, 1984

Related U.S. Application Data

[63] Continuation-in-part of Ser. No. 510,905, Jul. 5, 1983, abandoned.

[51] Int. Cl.[4] ..... F24C 15/10; A47G 23/02

[52] U.S. Cl. ..... 126/215; 126/214 D; 248/149; 248/152

[58] Field of Search ..... 126/214 D, 215, 50, 126/27; 248/146, 149, 152, 154; 222/146 R, 146 H, 146 HA, 146 HE; 219/433; 239/135, 273

[56] References Cited

U.S. PATENT DOCUMENTS

| | | | |
|---|---|---|---|
| 600,398 | 3/1898 | Bailey | 126/215 |
| 2,837,081 | 6/1958 | Ayers | 126/215 |
| 4,011,992 | 3/1977 | Olsen | 126/215 |

FOREIGN PATENT DOCUMENTS

| | | | |
|---|---|---|---|
| 51476 | 12/1919 | Sweden | 126/37 |

*Primary Examiner*—Larry Jones

*Attorney, Agent, or Firm*—Bogucki, Scherlacher, Mok & Roth

[57] ABSTRACT

A stand for supporting a non-stick cooking liquid spray dispenser at a predetermined height above a heated cooking surface, such as a griddle, is disclosed. The stand, fabricated of an insulating material such as a high temperature plastic, is a generally tubular structure including a base section, an upper section for receiving and retaining the dispenser and a smaller diameter intermediate section joining the base and upper sections. The intermediate section defines a chamber in communication with the upper section for retaining sufficient air heated by the high temperature griddle to maintain the desired temperature level of the cooking liquid. Baffling disposed between the chamber and the base section deflects hot air rising from the griddle and provides radiative surfaces so that the temperature of the cooking liquid does not exceed a temperature range that is optimum for applying the liquid to the cooking surface by spraying. In accordance with an optional variation, the cap originally supplied with the dispensing bottle may be inserted in the chamber to further insulate the bottle from the cooking surface so as to limit the temperature increase of the cooking liquid.

19 Claims, 8 Drawing Figures

STAND FOR SUPPORTING COOKING LIQUID SPRAY DISPENSER RELATIVE TO A HEATED SURFACE AND CONTROLLING THE TEMPERATURE OF THE LIQUID

RELATED APPLICATION

This application is a continuation-in-part of application Ser. No. 510,905 filed July 5, 1983, now abandoned.

FIELD OF THE INVENTION

The present invention relates generally to the heating of liquids to facilitate their dispensing by spraying, and particularly to a device for supporting a cooking liquid spray dispenser above a heated surface and maintaining the contents thereof within a predetermined temperature range.

BACKGROUND OF THE INVENTION

Various cooking fats and oils have been used in home, restaurant and commercial kitchens to prevent foods from sticking to hot cooking surfaces such as griddles and to flavor and brown the food as well. These substances, which typically include as their principal ingredients a partially hydrogenated vegetable oil and lecithin, may be dispensed simply by ladling a quantity out of an open top receptacle onto the hot griddle. Another substance often used, butter, is melted in a receptacle and poured onto the griddle or applied to the food with a brush. However, because these methods tend to be wasteful and ineffective if an excessive amount is applied, cooking fats and oils are supplied in aerosol cans which provide considerably greater control over the amount of liquid dispensed and its distribution along the cooking surface. Since the contents of these dispensers are under high pressure, however, great care must be exercised when using these containers around sources of heat such as stoves.

An approach to the dispensing of non-stick cooking liquids by spraying which avoids the use of pressurized aerosol cans is disclosed in U.S. Pat. No. 4,011,992 issued Mar. 15, 1977 to Olsen. There, a dispensing bottle fitted with a pump-type sprayer is supported on a stand at a predetermined height above the griddle with the object of maintaining the temperature of the non-stick cooking liquid at a level at which the viscosity thereof is sufficiently reduced to permit its application to the griddle by spraying. In accordance with the teachings of the Olsen patent, the stand is designed to maintain the temperature of the contents of the bottle at about 120° F. with a griddle temperature ranging from 385° to 400° F.

The stand disclosed in the Olsen patent is constructed of stainless steel wire shaped to define four legs and a bottle holder. The bottle rests on a stainless steel plate, either solid or perforated, carried by the wire stand. The heat conducting elements of the Olsen stand help to transmit heat from the griddle to the bottle to raise the temperature of the contents to the desired level. The Olsen stand, however, tends to be bulky, not only taking up a relatively large area of the griddle but supporting the bottle at a relatively high level. If the height of the stand is reduced substantially below the 4½ inches suggested in the patent, portions of the stand can become too hot to touch.

SUMMARY OF THE INVENTION

In accordance with the present invention, a compact stand is provided for supporting a non-stick cooking liquid spray dispenser at a predetermined, relatively low height above a heated cooking surface. The stand is formed of an insulating material such as a high temperature moldable thermoplastic or thermosetting plastic and so configured that it may be readily handled during use. The stand is moreover designed to efficiently maintain the contents of the dispenser within a temperature range that is optimum for spray-application of the non-stick cooking liquid. The structural features of the present stand permit the bottle to be supported closer to the cooking surface, for example, at 3½ inches above the surface, and maintain proper temperature control of the liquid, while remaining cool to the touch.

Broadly, the stand includes a base section, an upper section configured to receive and snuggly retain the dispensing bottle and an intermediate section joining the base and upper sections. The upper section includes a horizontal floor or bottom wall for supporting the dispensing bottle. The intermediate section defines a chamber for receiving and retaining air heated by the griddle, the chamber opening into the upper section of the stand through the floor of that section. The heated air within the chamber, as well as heat radiated from the griddle surface, are the principal sources of heat for warming the cooking liquid.

In accordance with another feature of the invention, a baffle plate is disposed between the base section and the chamber for deflecting hot air rising from the griddle within the confines of the stand and compelling that air to flow around the outside of the dispenser. The bottle plate and bottom wall of the upper section also serve as heat dissipation surfaces. Moreover, vents may be provided in association with the chamber to provide an egress for heated air to prevent excessive temperature buildup within the confines of the stand. Pursuant to another variation of the invention, the plastic cap originally supplied with the dispensing bottle may be inserted in the chamber whose wall is dimensioned to form a close fit about the cap. The additional insulation provided by the cap tends to limit the temperature increase of the cooking liquid and, for a given griddle temperature, maintains the cooking liquid at a lower temperature than that in the absence of the cap.

BRIEF DESCRIPTION OF THE DRAWINGS

The invention will be more clearly understood with reference to the detailed description below, taken in conjunction with the accompanying drawings in which.

DETAILED DESCRIPTION

Figure 1:
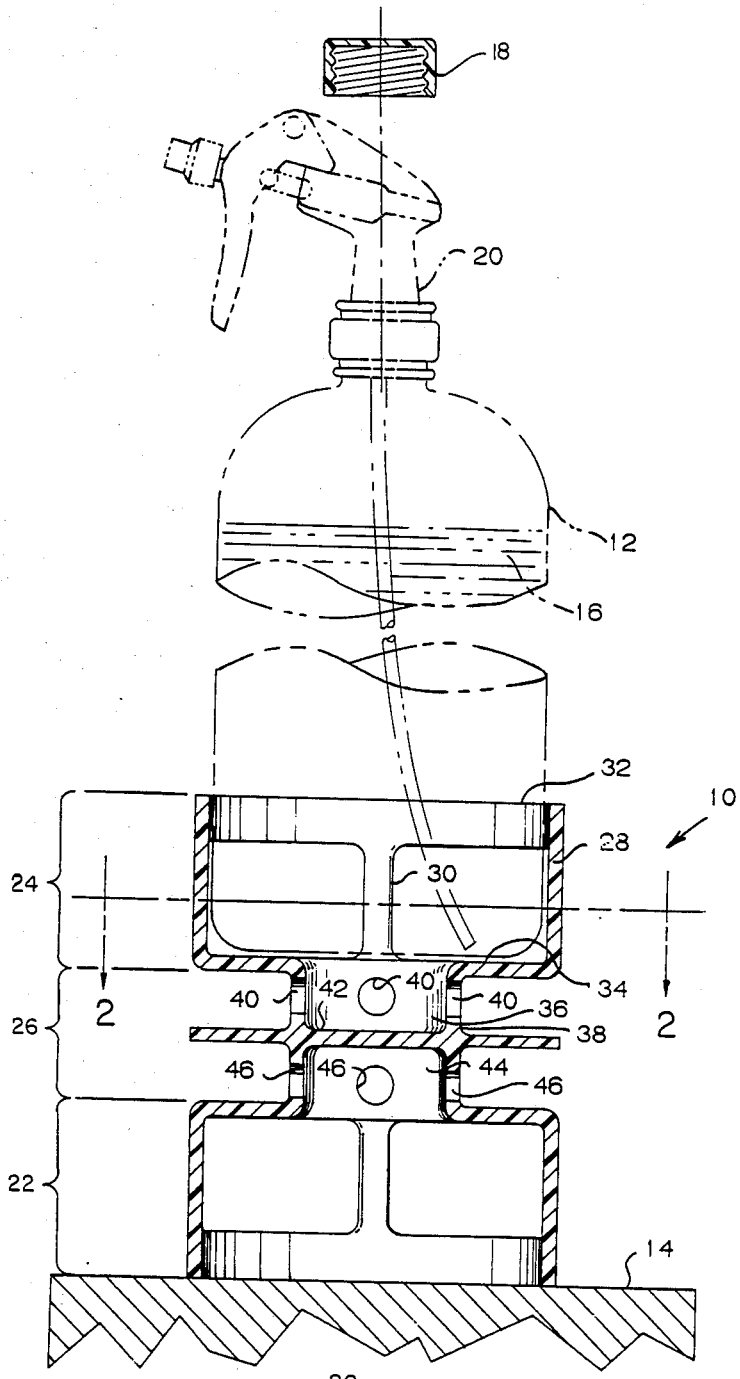
FIG. 1 is a side elevation view, in cross-section, of a first embodiment of a stand in accordance with the present invention.
Figure 2:
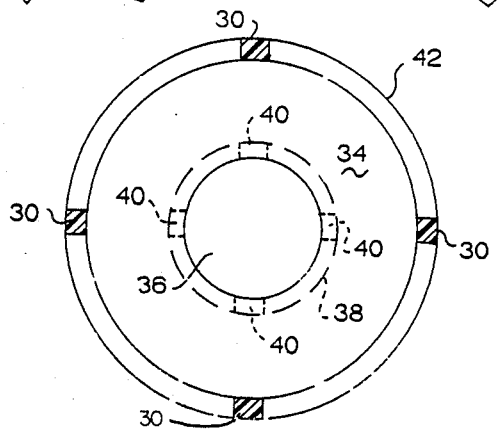
FIG. 2 is a transverse cross-section of the stand of FIG. 1 as seen along the plane 2—2.

In FIGS. 1 and 2 there is shown a stand 10 in accordance with a first illustrative embodiment of the invention, supporting a spray dispensing bottle 12 at a predetermined height above a heated cooking surface in the form of a griddle 14. The bottle 12 contains a quantity of non-stick cooking liquid 16 comprising principally, by way of example, a vegetable oil and lecithin. The viscosity of the liquid 16 is such that at room temperature it cannot be efficiently dispensed by spraying. Accordingly, the present invention utilizes the heat of the cooking surface 14 to raise the temperature of the non-stick cooking liquid in the bottle 12 to a level at which it can be dispensed and applied in a fine spray without overspraying.

The bottle 12 is originally sealed with a plastic cap 18 which is removed and replaced by a hand operated, pump-type spray nozzle 20 basically of the type disclosed in U.S. Pat. No. 3,701,478 issued Oct. 31, 1972. As will be presently explained in greater detail, the cap 18 can be advantageously used in conjunction with the stand of the invention as an optional temperature control device.

The stand 10 is a generally tubular structure including a lower or base section 22, an upper section 24 and an intermediate section 26 joining the base and upper sections. The stand is preferably fabricated of a high temperature resin or blend of resins which can withstand the temperatures involved and be readily formed into desired shapes by injection or compression molding. The bottle 12 fits snuggly within the upper section 24 so that in use the bottle and stand may be lifted from the griddle as a single unit. The section 24 has a tubular side wall 28 cut away to form an open frame structure including four vertical struts 30 integral with, and joined by, an upper ring 32. The section 24 further has an annular, horizontal floor or bottom wall 34 adapted to be engaged by the bottom of the dispensing bottle. The transverse floor or bottom wall 34 is positioned about 3½ inches above the level of the griddle 14, in accordance with one specific form of the invention.

Below the section 24 is a cylindrical chamber 36 defined by a tubular wall 38 of somewhat smaller diameter than that of the upper section. The wall 38 has four, uniformly spaced apertures 40 for venting heated air from the chamber 36 at a controlled rate. Although four such apertures are shown, it will be evident to those skilled in the art that the number of vents as well as their size and location can be varied from that specifically shown here. Below the chamber 36 and forming the bottom wall thereof is a circular baffle plate 42 having an outer diameter substantially the same as that of the upper and base sections. Preferably, the floor 34 and baffle 42 should be separated sufficiently so as not to trap heated air in between. In accordance with the example under consideration, that separation is about ½ inch. The floor 34 and baffle 42 also serve as heat dissipation elements.

In the embodiment of FIG. 1, the stand is symmetrical about the baffle plate so that each end may function as the base section or upper section thereby making use of the stand more convenient. Thus, the preceding description of the portion of the stand above the baffle 42 is fully applicable to the remaining portion of the stand below the baffle, that portion including inverted chamber 44 with vent holes 46. Although the described symmetry is preferred, it will be evident that one of the sections 22 or 24 may be taller than the other so that the stand may be used with either low or high temperature grills. Thus, when used in conjunction with a low temperature grill (for example, 290°–350° F.), the shorter section is used as the base section.

In operation, heated air rising within the confines of the base section from the griddle, whose surface is typically maintained at about 375°–400° F., flows out through the openings in the base section and through the vents 46 and around the baffle 42. Accordingly, in this embodiment, none of the heated air impinges directly on the bottom of the dispenser. In addition, conduction of heat from the griddle is minimized because of the open structure of the base section 22 whose relatively narrow, insulative struts (identical to the struts 30 of the upper section 24), provide poor heat-conducting paths. Moreover, any heat conducted by those struts tends to be radiated to the surroundings by the horizontal upper wall of the base section (which upper wall is the counterpart of the bottom wall 34 of the upper section 24) as well as the baffle 42. Heated air retained within the chamber 36 provides a constant source of heat contributing to the maintenance of a uniform cooking liquid temperature of about 120° F.

Figure 3:
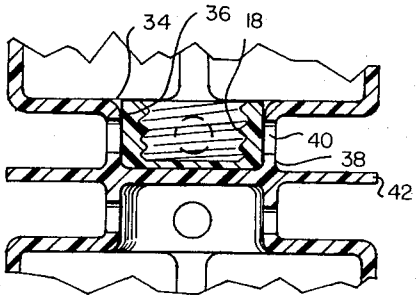
FIG. 3 is a side elevation view, in cross-section, of a portion of the stand of FIG. 1 showing a variation thereof employing the cap of the dispensing bottle.

With reference to FIG. 3, the insulating properties of the cap 18 originally supplied with the dispenser may be advantageously employed in conjunction with the stand. In this connection, as shown in FIG. 3, the cap may be inserted, open end up, within the chamber 36 which is dimensioned to receive the cap in a close fit with the result that both the temperature of the cooking oil and the temperature differences therein are reduced. As another aspect of this feature, the stand, with the cap tightly held by the walls of the chamber 36, may be threaded onto the bottle following removal of the pump spray 20. In effect, the stand and cap combination serves as the bottle closure and allows the bottle and stand to be stored in a small space.

Figure 5:
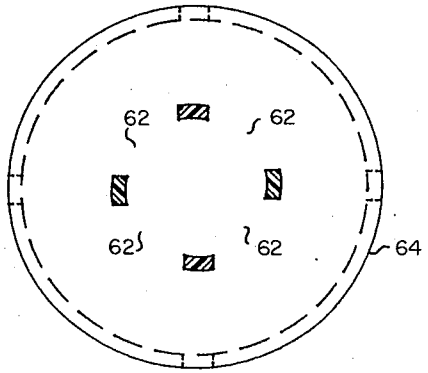
FIG. 5 is a transverse cross-section of the embodiment of the stand shown in FIG. 4 as seen along the plane 5—5.
Figure 4:
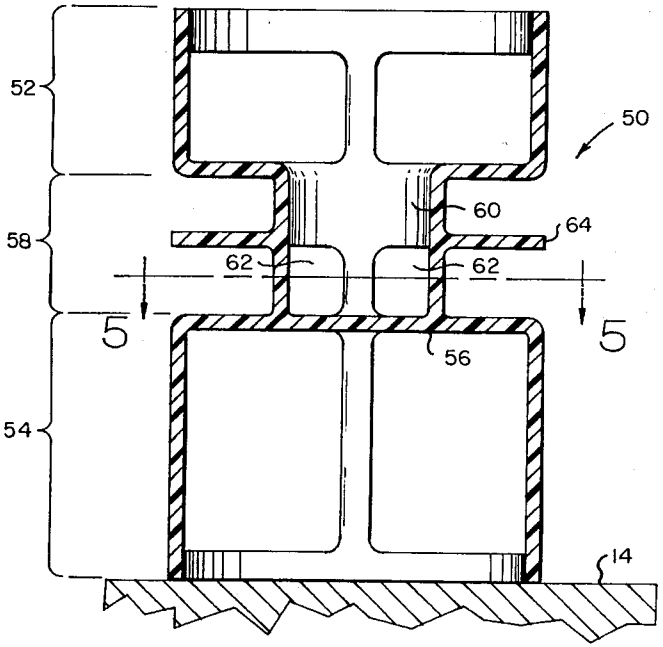
FIG. 4 is a side elevation view, in cross-section, of a second embodiment of the invention.

The second embodiment, shown in FIGS. 4 and 5, comprises a stand 50 including a bottle-receiving upper section 52 substantially identical to the section 24 of the embodiment of FIG. 1. A base section 54, similar to the base section 22 except that it is somewhat taller, terminates at its upper extremity in a solid, horizontal web 56 functioning as a baffle plate. The upper and base sections 52, 54 are interconnected by a smaller diameter, tubular, intermediate section 58. The upper part of that section defines a chamber 60 communicating at its upper end with the upper section 52 while the lower part is provided with vents 62. An auxiliary baffle 64, projecting from the outer surface of the intermediate tubular section at a point midway between the upper and base sections, may be included to deflect heated air discharged from the vents 62. The various horizontal surfaces of the stand function as cooling means. As in the embodiment of FIG. 3, the bottle cap 18 may be inserted in the chamber 60 to limit the temperature of the cooking liquid to the desired range.

Figure 6:
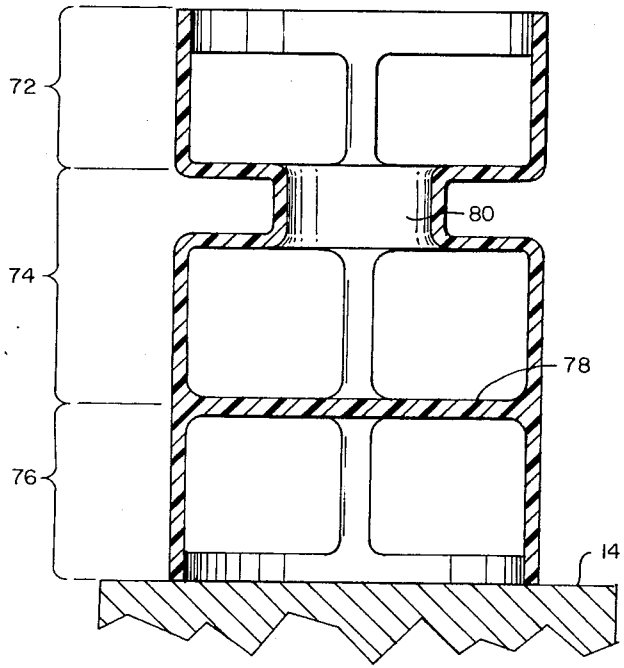
FIGS. 6, 7 and 8 are side elevation views, in cross-section, of third, fourth and fifth embodiments of the invention.

In the form of the invention shown in FIG. 6, the stand 70 includes tubular upper, intermediate and base sections designated by the reference numerals 72, 74 and 76, respectively. The upper section is identical to that of the previous embodiments. A circular baffle 78, extending across the entire diameter of the stand, defines the upper extremity of the open frame base section. The intermediate section includes, first, a cylindrical chamber 80 whose upper end opens into the upper section 72 as in the previous embodiments, and second, a larger diameter, vented portion 82 forming a continuation of the base section 76. Once again, the bottle cap 18 may be used as additional insulation by inserting it in the chamber 80.

Figure 7:
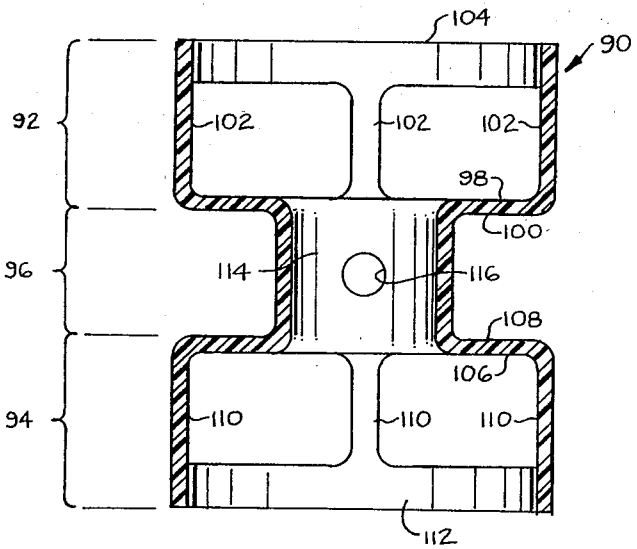

Turning now to FIG. 7, there is shown a stand 90 in accordance with yet another embodiment of the invention for use with grills operating at relatively low temperatures, for example, in the range of 290°-350° F. Accordingly, the basic design concept of the stand 90 is the same as that of the stand 10 (FIG. 1) except that the stand 90 has no auxiliary baffle such as the baffle plate 42 in the embodiment of FIG. 1.

The stand 90 is an integral tubular structure having an upper section 92, a base section 94 and an intermediate section 96, all structurally similar to the corresponding sections in the embodiments already described. Briefly, the upper section 92 has an annular transverse floor or bottom wall 98 with an outer horizontal surface 100. Upstanding, relatively narrow struts 102 projecting from the wall 98 are joined at their upper ends by a ring 104. The base section 94 is identical to the upper section 92, including an annular, transverse upper wall 106 having an outer horizontal surface 108 in confronting relationship with the surface 100, struts 110 and a ring 112.

The tubular intermediate section 96, of substantially smaller diameter than the upper and base sections, defines a chamber 114 which opens into both the upper and base sections 92 and 94. The wall of the intermediate section may be provided with one or more vents 116, as already described in connection with the other embodiments of the invention.

The upper and base sections 92 and 94 may be identical in which case the stand of FIG. 7 will be symmetrical about the intermediate section; alternatively, one of the sections 92 or 94 may be taller than the other to accommodate grills operating at different temperatures.

As with the embodiments previously described, heat control is effected by the stand 90 by the action of the chamber 114 in conjunction with the optical vent means 116, as well as by the limitation of heat conduction along the narrow struts 110 and the radiation from the horizontal surface 108 and to a lesser extent, from horizontal surface 100.

Figure 8:
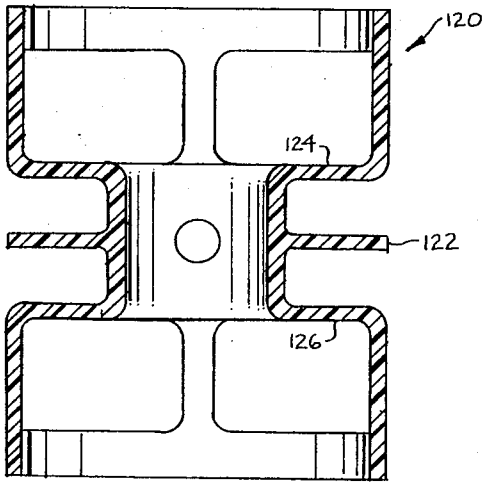

FIG. 8 shows yet another alternative embodiment of the invention comprising a stand 120 identical to that of FIG. 7 with the exception that the stand 120 includes a partial baffle plate 122 projecting from the intermediate section to provide auxiliary radiating surfaces between the transverse walls 124 and 126 of the upper and base sections, respectively.

Although particular stands have been shown and described to illustrate various forms such devices might take in accordance with the invention, it will be appreciated that the present invention is not limited to those particular forms or embodiments. Accordingly, any and all modifications, alterations and equivalent arrangements falling within the scope of the claims set forth below should be considered to be part of the present invention. For example, and without limitation, the diameter of the base section of the stand may be enlarged to increase the stability of the stand; the diameter of the baffle plate may be increased or reduced from that shown; the stand may have a square rather than a circular cross-section; and the height of the bottle above the heated cooking surface may be varied from the examples disclosed herein.

What is claimed is:

1. A stand made of insulating material for supporting a spray dispenser of non-stick cooking liquid at a predetermined elevation above a heated surface to maintain the temperature of the liquid at a level at which it can be readily sprayed, said stand comprising:

an upper section adapted to receive and grip the spray dispenser, the upper section including a transverse bottom wall;

a base section adapted to rest on the heated surface, the base section being spaced from said upper section and including a transverse upper wall having a substantially horizontal outer surface; and an intermediate section joining the transverse bottom wall of the upper section and the substantially horizontal outer surface of the base section, said intermediate section, said upper and base sections comprising open frame structures including cutaway portions defining generally vertically oriented struts joined at their outer ends by a ring defining chamber means opening into said upper and base sections.

2. A stand, as defined in claim 1, in which:

the transverse bottom wall of the upper section has a substantially horizontal outer surface and the substantially horizontal outer surfaces of the upper and base sections are in confronting relationship; and the chamber means includes at least one opening for venting heated air into the space between said surfaces.

3. A stand, as defined in claim 2, in which:

a substantially horizontal baffle plate is carried by and projects from said intermediate section, said baffle plate being disposed between said outer, substantially horizontal surfaces of the upper and base sections.

4. A stand, as defined in claim 3, in which:

the baffle plate extends through said chamber means and divides said chamber means into an upper chamber opening into said upper section and a lower chamber opening into said base section.

5. A stand, as defined in claim 3, in which:

the upper and base sections are substantially identical and substantially symmetrically disposed about said baffle plate.

6. A stand made of insulating material for supporting a spray dispenser of non-stick cooking liquid at a predetermined elevation above a heated surface to maintain the temperature of the liquid at a level at which it can be readily sprayed, said stand comprising:

a tubular upper section adapted to receive and grip the spray dispenser, the upper section including an annular transverse bottom wall having a horizontal outer surface;

a tubular base section adapted to rest on the heated surface, the base section being spaced from said upper section and including an annular transverse upper wall having a horizontal outer surface in confronting relationship with the horizontal outer surface of the bottom wall of the upper section, the base section further comprising an open frame structure defined by struts depending from the transverse upper wall and joined at their lower ends by a circular rim; and a tubular intermediate section joining the upper and base sections and having an outer diameter smaller than the upper and base sections, said intermediate section extending between the confronting horizontal surfaces of said upper and base sections.

7. A stand, as defined in claim 6, in which:
the height of the base section is greater than the height of the upper section.

8. A stand, as defined in claim 6, in which:
the intermediate section defines chamber means opening into said upper and base sections.

9. A stand, as defined in claim 8, in which:
the intermediate section includes at least one opening for venting heated air from said chamber means into the region between said confronting horizontal surfaces.

10. A stand, as defined in claim 8, in which:
a substantially horizontal baffle plate projects from said intermediate section, the baffle plate being disposed between said confronting horizontal surfaces.

11. A stand, as defined in claim 10, in which:
the upper section is identical to the base section, said upper and base sections being symmetrically disposed about said baffle plate, said plate further having the same outer diameter as the upper and base sections.

12. A stand, as defined in claim 11, in which:
the baffle plate extends through said chamber means, dividing said chamber means into symmetrically disposed upper and lower chambers.

13. A stand, as defined in claim 12, in which:
the intermediate section includes at least one opening above and below said baffle plate for venting said upper and lower chambers.

14. A stand, as defined in claim 6, in which:
the upper section is identical to the base section, said sections being symmetrically disposed about said intermediate section.

15. A stand made of insulating material for supporting a spray dispenser of non-stick cooking liquid at a predetermined elevation above a heated cooking surface to maintain the temperature of the liquid at a level at which it can be sprayed, said stand comprising:
a base section;
an upper section spaced from said base section and configured to receive and grip the lower part of the dispenser, said upper section including a horizontal, bottom wall adapted to be engaged by the bottom of the dispenser; and
an intermediate section connecting the base and upper sections and defining a chamber proximate said upper section for retaining sufficient heated air to maintain said temperature level, said chamber including a portion shaped and dimensioned to receive and hold the cap of the dispenser.

16. A stand made of insulating material for supporting a spray dispenser of non-stick cooking liquid at a predetermined elevation above a heated cooking surface to maintain the temperature of the liquid at a level at which it can be sprayed, said stand comprising:
a base section;
an upper section spaced from said base section and configured to receive and grip the lower part of the dispenser, said upper section including a horizontal, bottom wall adapted to be engaged by the bottom of the dispenser;
a disk-shaped, horizontal baffle disposed below said bottom wall of said upper section, said baffle having a diameter coextensive with that of the upper section for deflecting heated air rising from the cooking surface, the baffle also providing heat dissipation; and
an intermediate section connecting the base and upper sections and defining a chamber proximate said upper section for retaining sufficient heated air to maintain said temperature level, the base, intermediate and upper sections being generally tubular structures, the base and upper sections having the same diameter, and the stand being symmetrical about the baffle, the portion of the stand above the baffle being identical to the portion of the stand below the baffle.

17. A stand made of insulating material for supporting a spray dispenser of non-stick cooking liquid at a predetermined elevation above a heated cooking surface to maintain the temperature of the liquid at a level at which it can be sprayed, said stand comprising:
a base section adapted to rest on the heated cooking surface;
an upper section disposed above the base section and spaced therefrom, the upper section being configured to receive and hold the dispenser, the upper section including a horizontal, bottom wall; and
means for joining the base section and the upper section and including baffle means for deflecting heated air rising from said heated surface and causing said heated air to flow about the outside of the upper section, the base and upper sections having generally cylindrical configurations, the baffle means comprising a disk-shaped, horizontal baffle disposed below said bottom wall of said upper section and the stand being symmetrical about the baffle, the portion of the stand above the baffle being substantially identical to the portion of the stand below the baffle.

18. A stand made of insulating material for supporting a spray dispenser of non-stick cooking liquid at a predetermined elevation above a heated surface to maintain the temperature of the liquid at a level at which it can be readily sprayed, said stand comprising:
an upper section comprising an open frame, tubular structure having an open upper end and a horizontal bottom wall, the upper section being adapted to receive and grip the lower portion of the dispenser;
a base section adapted to rest on the heated surface, the base section being below said upper section and spaced therefrom, said base section having a horizontal upper wall and being substantially identical to and concentric with the upper section, said base section further being symmetrically disposed with respect to the upper section so that the functions of the two sections are interchangeable;
a generally tubular intermediate section joining the upper and base sections and disposed concentric therewith, the intermediate section having an outer diameter smaller than that of the upper and base sections and defining an upper chamber opening into the upper section through the bottom wall thereof and a lower chamber opening into the base section through the upper wall thereof, said upper and lower chambers being substantially identical and symmetrically disposed; and
a disk-shaped, horizontal baffle plate carried by the intermediate section, the baffle plate having an outer diameter that is substantially the same as the outer diameter of the upper and base sections, said last-mentioned sections and said upper and lower chambers being substantially symmetrically disposed about said baffle plate.

19. A stand, as defined in claim 18, in which:
each of said chambers includes openings for venting heated air at a controlled rate.

* * * * *

UNITED STATES PATENT AND TRADEMARK OFFICE

CERTIFICATE OF CORRECTION

PATENT NO. : 4,627,414

DATED : Dec. 9, 1986

INVENTOR(S) : Neal H. Chazin

It is certified that error appears in the above-identified patent and that said Letters Patent are hereby corrected as shown below:

In claim 1, at column 6, line 16, after "section" and before the comma [","], insert --defining chamber means opening into said upper and base sections--.

In claim 1, at column 6, lines 19-21 between "ring" and the period [.], delete "defining chamber means opening into said upper and base sections".

Signed and Sealed this

Eighth Day of September, 1987

*Attest:*

DONALD J. QUIGG

*Attesting Officer*

*Commissioner of Patents and Trademarks*